United States Patent [19]

Ward et al.

[11] Patent Number: 4,775,001

[45] Date of Patent: Oct. 4, 1988

[54] ZONED AIR CONDITIONING SYSTEM

[75] Inventors: Colin W. Ward, Gordon; Norman Stoliar, Lindfield; Lewis Marton, Randwick; Geoffrey N. Beeche, Balmain; Leslie Phipps, Turramurra, all of Australia

[73] Assignee: Atlas Air (Australia) Pty. Limited, Rozelle, Australia

[21] Appl. No.: 858,758

[22] Filed: May 2, 1986

[30] Foreign Application Priority Data

Jul. 5, 1985 [AU] Australia ..... PH1341

[51] Int. Cl.[4] ..... F24F 3/00; F24F 3/06; F24F 13/04; F24F 13/18

[52] U.S. Cl. ..... 165/22; 165/50; 165/57; 165/124; 165/108; 98/34.5; 98/34.6; 98/31.5; 98/31.6; 98/40.19; 98/39.1; 98/38.9

[58] Field of Search ..... 165/57, 123, 22, 53, 165/108, 124, 50; 98/34.5, 34.6, 31.6, 31.5, 40.19, 38.9, 31, 39.1, DIG. 7, 38.5

[56] References Cited

U.S. PATENT DOCUMENTS

| | | | |
|---|---|---|---|
| 19,104 | 1/1858 | Smith | 37/114 |
| 760,182 | 5/1904 | Chapman et al. | 98/37 |
| 2,115,482 | 4/1938 | Crewe | 98/DIG. 7 |
| 2,319,703 | 5/1943 | Olson | 98/33 |
| 2,422,600 | 1/1969 | Chamberlain | 55/126 |
| 3,262,491 | 7/1966 | Selhost | 165/48.1 X |
| 3,289,746 | 12/1966 | Kline | 165/123 X |
| 3,376,916 | 4/1968 | Gressett | 165/22 |
| 3,470,945 | 10/1969 | Schmidt | 165/123 X |
| 3,669,349 | 6/1972 | Hall, Jr. | 98/38.5 |
| 3,720,258 | 3/1973 | Chandler | 165/22 |
| 3,726,204 | 4/1973 | Linderstrom | 98/36 |
| 3,744,556 | 7/1973 | Church | 165/57 |
| 3,923,482 | 12/1975 | Knab et al. | 55/412 |
| 3,929,285 | 12/1975 | Daugherty, Jr. | 98/38.9 |
| 4,084,389 | 4/1978 | Meckler | 98/38.9 |
| 4,121,655 | 10/1978 | Hart | 165/27 |
| 4,135,440 | 1/1979 | Schmidt et al. | 98/31 |
| 4,250,800 | 2/1981 | Brockmeyer | 98/DIG. 7 |
| 4,253,384 | 3/1981 | Schmidt et al. | 98/40 R |
| 4,353,411 | 10/1982 | Harter et al. | 98/40.19 |
| 4,531,454 | 7/1985 | Spoormaker | 91/31.6 |
| 4,589,331 | 5/1986 | Villamagna et al. | 98/39.1 |

FOREIGN PATENT DOCUMENTS

| | | | |
|---|---|---|---|
| 633906 | 2/1962 | Italy | 98/40.19 |
| 0060130 | 4/1982 | Japan | 98/39.1 |
| 0062332 | 4/1982 | Japan | 165/57 |
| 0056640 | 4/1984 | Japan | 165/57 |
| 1290667 | 9/1972 | United Kingdom | 165/57 |
| 1320534 | 6/1973 | United Kingdom . | |
| 1528170 | 10/1978 | United Kingdom . | |
| 2069127 | 8/1981 | United Kingdom | 98/38.9 |

*Primary Examiner*—Albert W. Davis, Jr.
*Assistant Examiner*—John K. Ford
*Attorney, Agent, or Firm*—Bacon & Thomas

[57] ABSTRACT

A zoned air conditioning system using a room air terminal which has the same horizontal dimensions as a floor tile of a raised tile floor such that the terminal may replace one tile in such a floor. The terminal includes a cool air inlet below the floor for drawing in cooling air circulated in the under floor space and a return air inlet in the top surface of the terminal. The cool air and return air is mixed in a mixing chamber and drawn from the mixing chamber by a fan and returned to the room through an outlet vent. The ratio of cool air to return air mixed in the mixing chamber is controlled by a modulating damper which is controlled in response to the temperature of the return air in order to control the room temperature in the region of the terminal in accordance with an adjustable set point. A heater is also provided in the terminal for those occasions where the return air is cooler than the set point.

11 Claims, 5 Drawing Sheets

ZONED AIR CONDITIONING SYSTEM

The present invention relates generally to air conditioning systems and in particular the invention provides a method and apparatus which enables different zones of the area being serviced by an air conditioning system to be maintained at different temperature levels.

Typically, in ducted air conditioning systems, the conditioned air is ducted to various points around the building being serviced and dampers are provided in the ducting system to regulate the flow of conditioned air to various zones of the building in order to compensate for differing loadings on the air conditioning system from one zone to another and also to accommodate differing temperature requirements in the various zones. However, such prior art ducted systems are not easy to balance and are therefore relatively inflexible in that it is a major task to alter the distribution of flow when changes occur to the usage of the space being conditioned.

It is also known to provide air conditioning systems wherein the conditioned air is distributed through a space defined by a raised false floor and emerges into the space to be cooled via strategically placed vents in the floor. Such systems are widely used in computer installations and other installations of electronic equipment where a large number of cables must be accommodated between different items of equipment. In such installations it is convenient to run cables in the space defined by the false floor and to use this space as an air distribution duct as well. Under floor distribution arrangements are also used in some general office air conditioning systems and in such systems it is common to locate fans under vents in the false floor to draw the cool air out of the under floor space into the area to be serviced, while return air vents, without fans, are also provided in the floor such that air can circulate between the serviced space and the under floor distribution area. In such prior art systems it is not uncommon for the volume of air being drawn from the under floor space to be up to three times the volume of cool air supplied by the air conditioning system, the under floor space being used as a mixing chamber to mix return air from the serviced area with the cooler air distributed through the under floor space. These prior art underfloor air distribution systems have the disadvantage that the positioning and control of fans under floor grills must be carefully determined to generate satisfactory air flow patterns both in the under floor space and the area to be serviced by the air conditioning system. Also, as the return air from the serviced area travels through the under floor space, typically without any means of filtration, there is generally a large accumulation of dirt and dust in this space.

According to a first aspect, the present invention consists in an air circulating terminal for a zone air conditioning system, said terminal comprising; mounting means adapted to be mounted in an opening of a barrier between a cooling air distribution plenum and a space to be serviced by the air conditioning system; an inlet chamber having a first inlet opening into said space to be serviced and a second inlet opening into said plenum; an outlet chamber opening into the space to be serviced; fan means located between said inlet chamber and said outlet chamber to propel air from said inlet chamber into said outlet chamber; proportioning means for controlling the proportion of air flowing into the inlet chamber from said first inlet and said second inlet respectively; temperature sensing means for sensing the temperature of air entering said first inlet; and modulating means for modulating said proportioning means in accordance with the temperature of air entering said first inlet to control the temperature of mixed air propelled to outlet chamber.

In a preferred embodiment of the invention, heating means are provided in the air circulation terminal such that when the temperature of the air entering the first inlet is less than the desired air temperature the proportioning means can shut off air flow through the second inlet and the air can be heated prior to being returned to the space being serviced by the air conditioning system.

According to a second aspect the present invention consists in a method of conditioning air in an air conditioned space, comprising the steps of supplying a flow of cooling air into a plenum separated from the air conditioned space by a barrier, drawing air from said plenum into a mixing chamber and at the same time drawing air from the air conditioned space into said mixing chamber and returning the air mixed in said mixing chamber to the air conditioned space, wherein the temperature of the air returned to the air conditioned space is controlled by modulating the proportion of air drawn from the plenum in accordance with the temperature of the air drawn from the air conditioned space.

According to a third aspect, the present invention consists in a local air delivery duct comprising inlet means adapted to be located in or connected to a source of conditioned air, a delivery duct connected to the inlet means and propulsion means adapted to propel air along the delivery duct, wherein the delivery duct has a first portion adjacent to the inlet means which is fixed relative to the inlet means and a second portion moveable with respect to the first portion, an air outlet vent being located in the second portion.

Preferably the local air delivery duct also incorporates a switch which is connected to control the operation of the propulsion means and the first and second duct portions are connected by flexible joint means. In other embodiments of the local air delivery duct, the duct is of modular construction and includes modules which provide services such as lighting, AC power outlets, air conditioning control panels, clocks or other desirable services.

Embodiments of the present invention will now be described in greater detail with reference to the accompanying drawings in which:

FIG. 1 schematically illustrates a known prior art air conditioning system making use of an under floor space for delivery of cooling air;

FIG. 2 schematically illustrates an air conditioning system which makes use of the present invention;

Figure 1:
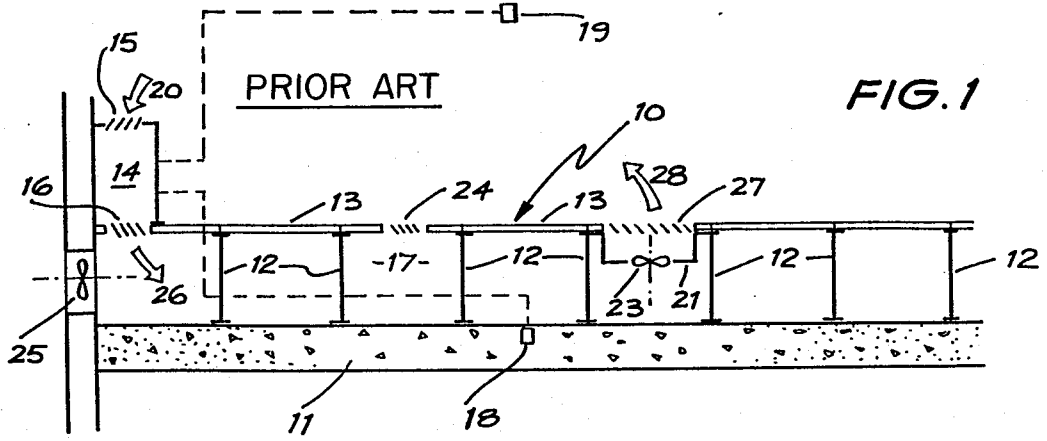

Referring to FIG. 1 an under floor delivery air conditioning system of a prior art design is shown, wherein a false floor 10 is mounted on top of a concrete slab 11 and rests on a plurality of jacks 12 which define a grid in which individual tiles 13 are laid to form the floor. Return air 20 is drawn into a cooling unit 14 of the air conditioning system through return air vents 15 and the cooled air 26 is blown under the floor via outlet vents 16 to provide a flow of cold air into the under floor space 17. Once under the floor, the cold air causes the slab 11 to cool and slab temperature is measured via a sensor 18 and used to control the operation of the air conditioning system cooling unit 14. Similarly, air temperature in the space serviced by the air conditioning system is measured by a temperature sensor 19 which is also used to control the air conditioning system.

In prior art systems of the type illustrated in FIG. 1, cool air from the under floor space 17 is drawn into the space to be serviced via an air delivery unit 21 comprising a grill 27 mounted in the raised floor 10 and a fan 23 to propel air 28 through the grill. Typically, a plurality of these delivery units 21 are provided and the total air flow through these units is significantly greater than the flow of air 26 supplied by the cooling unit 14 such that a proportion of return air flows through additional grills 24 provided in the floor and mixes with the cool air in the under floor space 17.

Optionally, systems of the type illustrated in FIG. 1 may also be fitted with means for drawing air from outside the building, such as fan 25, such that during the night when external temperatures are low, cold air can be drawn from outside to cool the slab 11 which acts as a thermal reservoir. In this way, a reduction in the required cooling capacity of the cooling system can be achieved by using the lower temperature of the slab 11 to cool return air passing through vent 24 during working hours when the air conditioning system is under load. However, arrangements which make use of external cold air during night time periods are only of use in environments where night time temperatures are sufficiently lower than day time temperatures, such as in cities which are built at high altitudes, but this system does not generally produce any great benefit in environments where the day time to night time temperature differential is low. Another advantage of under floor air distribution systems of the type described with reference to FIG. 1 is that each of the air distribution units 21 can be individually set in order to control the temperature in the region surrounding that distribution unit and therefore different temperature zones may be established in a building, according to the requirements and preferences of the person occupying those zones. Further, under floor distribution systems provide the added advantage that the under floor space may be used to distribute services such as power, water, fire sprinkler services, telephone services and various other cabling between pieces of office equipment.

Figure 2:
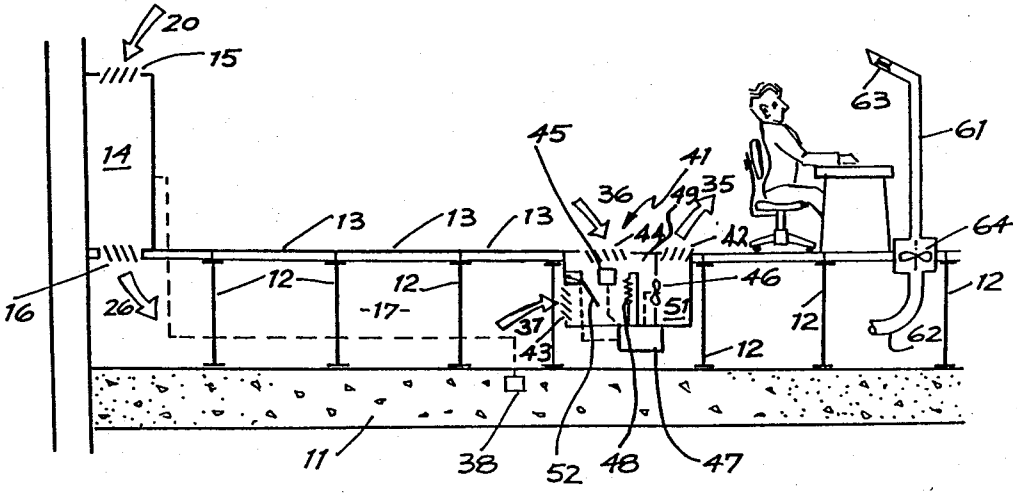

Referring now to FIG. 2, an air conditioning system in accordance with the present invention is illustrated, wherein the principle of under floor air distribution is utilized, but with significant differences over the prior art arrangements previously described with reference to FIG. 1. As with the arrangement of FIG. 1, an air cooling unit 14 draws air through return air vents 15 and cools the air before blowing it into the under floor space 17 through vents 16. Operation of the air conditioning cooling unit 14 is controlled to optimize the temperature in the under floor space 17 with the aid of temperature sensor 38 located in the slab 11.

Room air terminals 41 are provided at various locations throughout the air conditioned area and comprise a housing mounted in the floor and designed to replace one tile of the raised floor system, the housing having an inlet vent 44 in its upper surface to draw return air 36 from th conditioned space into an inlet chamber 49. The second vent 43 is provided in the side of the terminal unit 41 and allows air 37 to be drawn from the under floor space 17 and mixed in the inlet chamber 49 with the return air from the air conditioned space. The air from the inlet chamber 49 is then blown into an outlet chamber 51 by a fan 46 and the mixed air 35 is then expelled via a vent 42 into the air conditioned space. A control unit 47 measures the temperature of the air flowing through vent 44 via a sensor 45 and controls a modulating damper 52 to vary the proportion of air being drawn from the under floor space 17 in order to control the temperature of the air returned to the air conditioning space through the vents 42. In the event that air flowing through vents 44 is below the desired temperature which has been set, the modulating damper 52 is shut to close off air flow from the under floor space 17 and a heater 48 is activated to heat the air flowing back into the air conditioned space through vent 42. Each room air terminal 41 is provided with individual control allowing localised temperature zones to be established throughout the building in which the system operates, thereby providing a high degree of flexibility. The system is made even more flexible by the fact that room air terminals can be simply installed by removing one tile of the raised floor and replacing it with a room air terminal module which is totally self contained and only requires a supply of AC power. Therefore, the system of the present invention is suited to use in open plan office spaces where it is often desirable to be able to rearrange partitions and furniture to accommodate reorganisation and changes of staff within a company.

Another feature of the system of the present invention is the provision of local air delivery duct 61 comprising a duct having an inlet which draws air, either from the under floor space 17 or from the outlet chamber 51 of the room air terminal, and delivers it via a vent 63 to a localised region in the vicinity of an employee or a piece of equipment having particular cooling requirements. A fan 64 is provided at a point along the length of the duct 61 to propel air through the outlet vent 63 and this fan may be of a variable speed type having a control switch mounted on the local air delivery duct.

Figure 3:
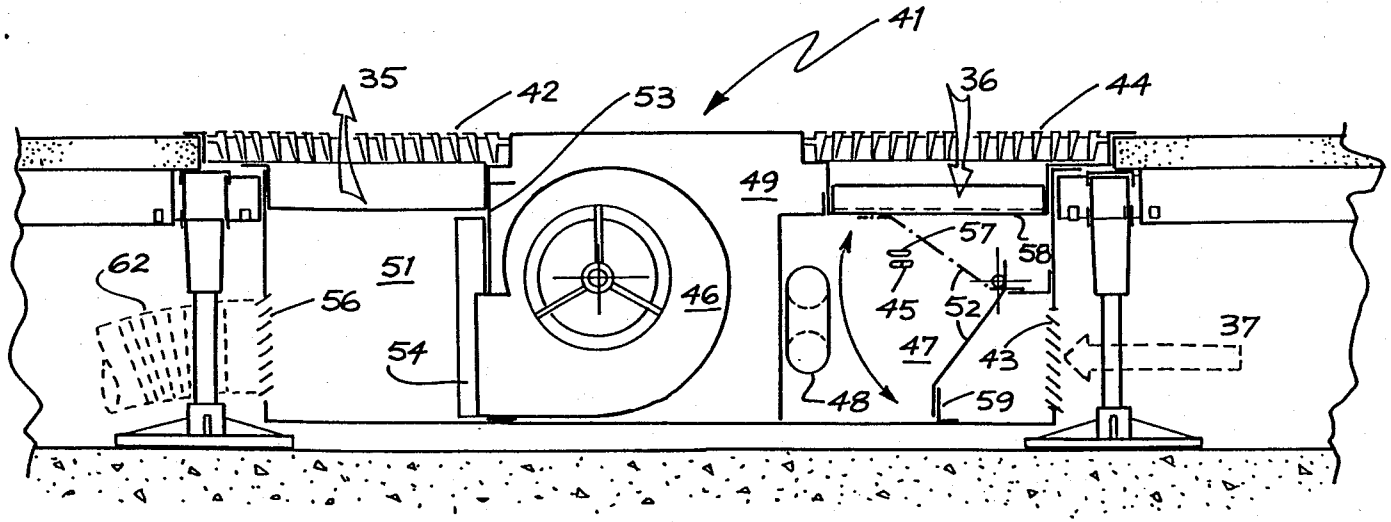
FIG. 3 is a sectional side view of air circulating terminal according to an embodiment of the present invention when installed in a raised floor.
Figure 4:
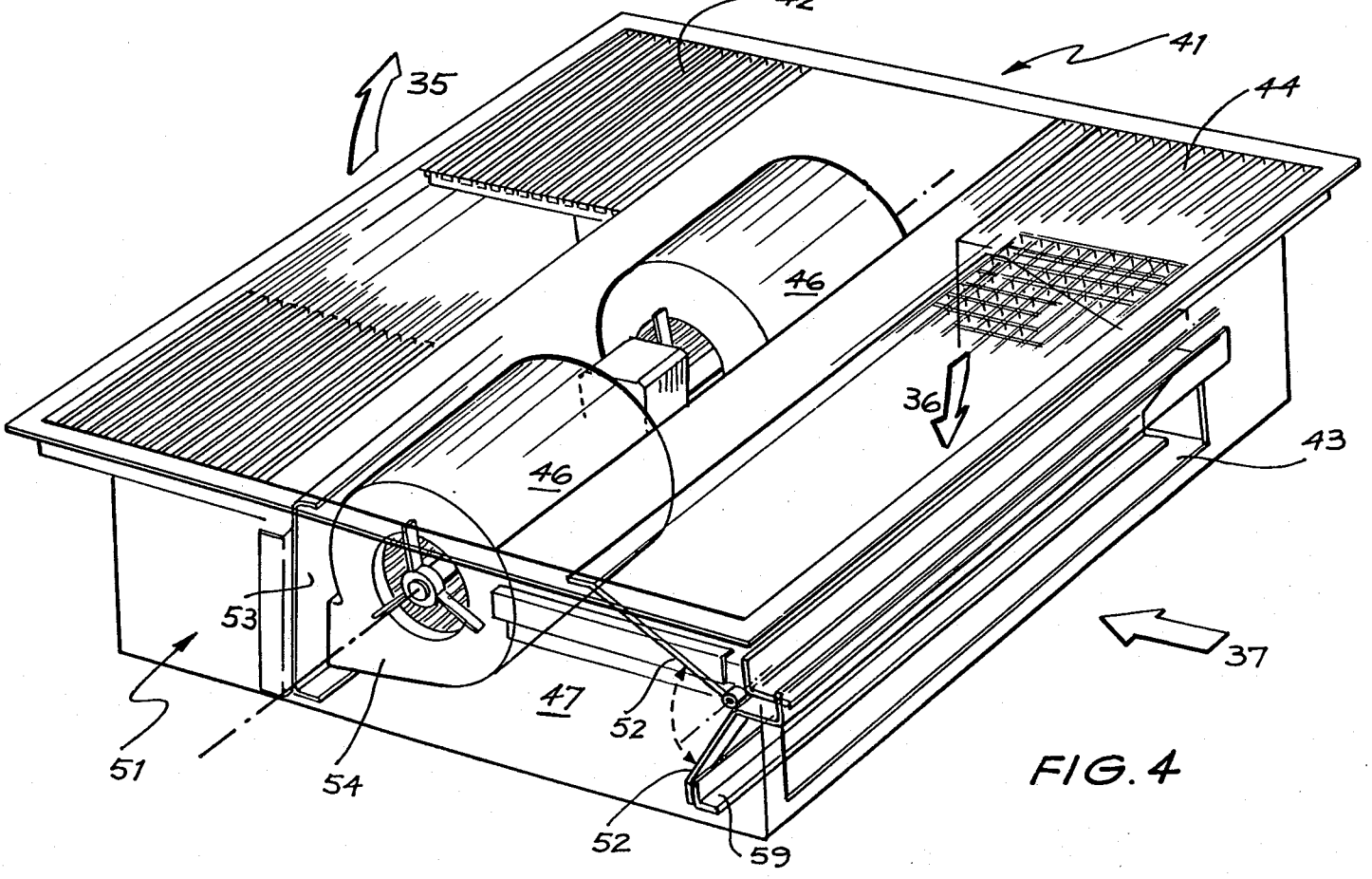
FIG. 4 is a perspective view of the air circulating terminal of FIG. 3 with one side and part of the top invisible.
Figure 5:
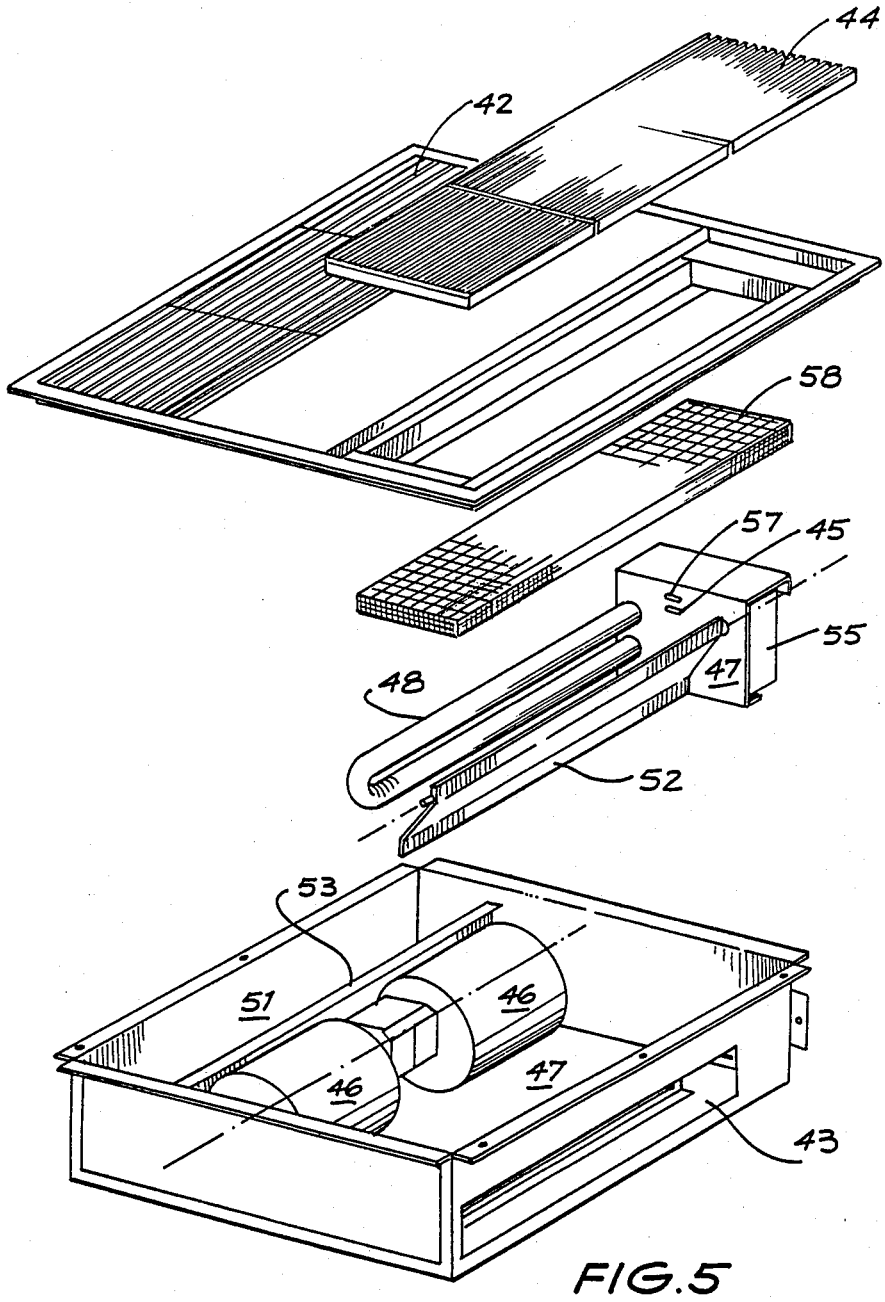
FIG. 5 is an exploded perspective view of the air circulating terminal of FIG. 3.

Referring now to FIGS. 3, 4 and 5, the room air terminal 41 is shown in greater detail, and it will be recognised that the terminal is essentially box like in construction having a central barrier 53 dividing the inlet chamber 49 from the outlet chamber 51 and through which the outlet duct 54 of a centrifugal fan 46 delivers air blown from the inlet chamber to the outlet chamber. The air damper 52 which controls the flow of cooling air through inlet vent 43 is arranged to sealingly engage the inlet vent 43 when the damper is fully closed, and further the damper control is arranged such that when power is removed from the unit, the damper 52 returns to the sealed position. The damper is opened by way of a modulating drive 55 (see FIG. 5) which is controlled by the control unit 47. The modulating drive 55 positions the damper 52 in response to the temperature sensed by the thermostat 45. In the outlet chamber 51, an optional secondary outlet 56 is provided for the attachment of a flexible duct 62 which connects the remote air terminal 41 to a local air delivery duct 61.

When the modulating damper 52 is fully closed and the temperature sensed by thermostat 45 is still below the desired temperature, a heater 48 located in the inlet chamber 49 is switched on to heat the air 36 before it is passed to the output chamber 51 via the fan 46. The set point temperature which is used as the basis for controlling the heater 48 and the modulating damper 52 may be varied via the temperature switch 57 on the control unit 47.

Air 36 flowing in through the inlet vent 44 is then passed through a filter 58 to remove dust and dirt particles which might otherwise collect in the inlet chamber 47 and pose a health hazard.

The damper 52 is positioned in relation to the inlet vents 43 and 44, such that air flow from the inlet vent 43 may be completely blocked off, whereas air flow from inlet vent 44 is never completely blocked, allowing a small amount of air to always be recirculated. When the damper 52 is in the fully lowered position it seals against a co-operating wall 59. In FIG. 3 the damper 52 is illustrated in solid line in the fully closed position against the wall 59 and in broken line in the fully open position.

Figure 6:
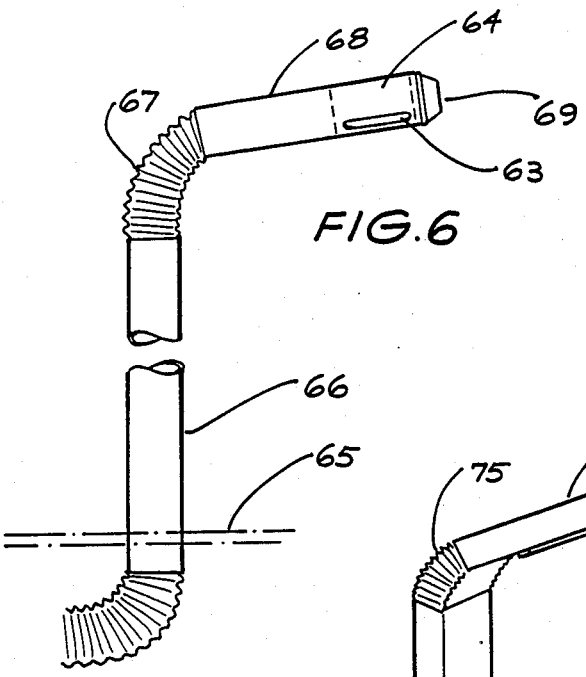
FIG. 6 is a perspective view of a first embodiment of a local air delivery duct in accordance with the present invention.

A first embodiment of a local air delivery duct is illustrated in FIG. 6, wherein a first tubular duct portion 66 extends from a floor tile 65 and terminates in a flexible joint 67 which connects the first duct portion 66 to a second movable duct portion 68. A centrifugal fan 64 is located at the outer end of the movable duct portion 68 and delivers air through a vent 63. Control of the fan 64 is provided by way of a rotary switch 69 located at the extremity of the movable duct portion 68.

Figure 7:
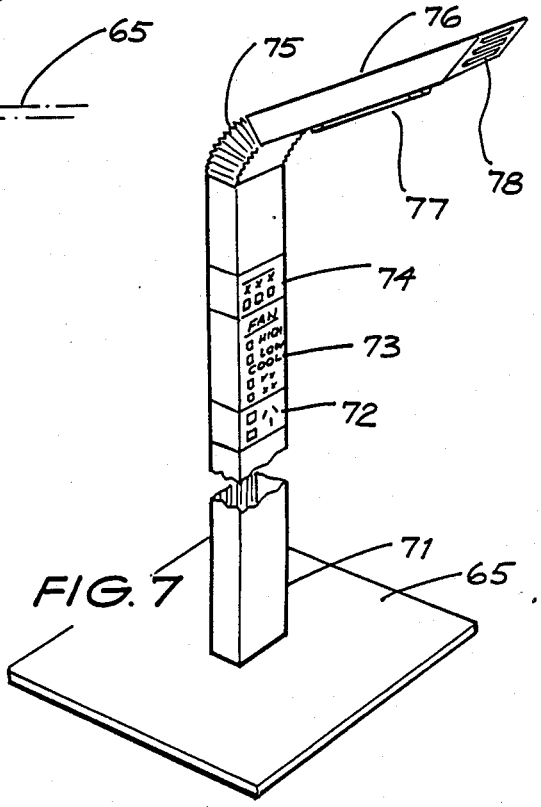
FIG. 7 is a perspective view of a second embodiment of a local air delivery duct.

A second embodiment of the local air delivery duct is illustrated in FIG. 7, and comprises a rectangular duct made from a plurality of modular sections, a lower section 71 extending through the floor tile 65 and modular service units 72, 73 and 74 extending above the base unit 71. A flexible joint 75 connects the vertical portion of the duct to a movable portion 76 in which the outlet vent 78 is provided. This movable portion of the duct may also be provided with a light source 77 such as a fluorescent lamp, which is conventionally controlled by one of the switches provided in the service modules 72, 73 and 74. Air is delivered from the duct through vents 78 in the lower (not shown) or end surfaces of the movable section 76.

A particular advantage of the system of the present invention is that different temperature zones may be set up within the area serviced by the air conditioning system and these zones may be altered as usage requirements of the building change, simply by varying the position of room air terminals and local air delivery duct modules. Further, unfiltered air is not allowed to flow into the under floor space in the arrangement of the present invention, thereby avoiding the build up of dirt and dust in this area. The internal chambers of the room air terminals, on the other hand, are readily accessible from above by removing the inlet and outlet grills and therefore the room air terminals themselves are relatively easily cleaned. Also, as the system of the present invention does not rely upon a significant positive pressure in the plenum to deliver air to the conditioned space, large floor areas can be serviced without the need for air guiding dampers and barriers under the floor to ensure even distribution of cooling air.

It will be recognised by persons skilled in the art that numerous variations and modifications may be made to the invention as described above without departing from the spirit or scope of the invention as broadly described.

We claim:

1. A self-contained air circulating terminal configured to be substituted for a floor module in a raised floor of an under floor delivery air conditioning system, said terminal being electrically powered and comprising: a housing configured to be connected into said raised floor in place of a floor tile at a floor tile receiving location and including an upper surface for flush disposition with the floor surface; an inlet chamber in said housing having a first inlet formed on the upper surface and opening into a space to be serviced and a second inlet provided through an opening located below the level of the raised floor to communicate with a plenum under said floor; an outlet chamber in said housing having an outlet formed in the upper surface and opening into the space to be serviced; an electric fan located between said inlet chamber and said outlet chamber to propel air from said inlet chamber to said outlet chamber; proportioning means for controlling the proportion of air flowing into the inlet chamber from said first inlet and said second inlet respectively; temperature sensing means for sensing the temperature of air entering said first inlet; and modulating means for modulating said proportioning means in accordance with the temperature of air entering said first inlet to control the temperature of the air propelled to the outlet chamber; and an electric power connection.

2. The terminal of claim 1 further including an electric heater operable in response to the temperature sensing means for heating the air flowing through the terminal when the temperture of the air flowing through the first inlet is below a predetermined level and the proportioning means is completely blocking airflow through the second inlet.

3. The terminal of claim 1 wherein the first inlet and the outlet are each provided with a grill at the upper surface of the housing.

4. The terminal of claim 1 wherein the proportioning means includes a damper.

5. The terminal of claim 1 further including a second air delivery means defined by a duct communicating with the outlet chamber.

6. The terminal of claim 5 wherein the duct further includes propulsion means for propelling air therethrough, a first portion fixed relative to the outlet chamber and a second portion moveable with respect to the first portion, and an air outlet vent located in the second portion.

7. The terminal of claim 6 further including a manually operable switch for controlling the operation of the propulsion means and flexible joint means connecting the first and second portions.

8. An air conditioning system comprising a plenum located below a raised floor for distributing cooling air to a conditioned space located above said floor; air cooling means drawing air from the conditioned space and delivering it to the plenum after cooling and an air circulating terminal mounted in the raised floor; said air circulating terminal being self-contained and configured to be substituted for a floor tile in said raised floor, said air circulating terminal comprising: a housing configured to be connected into said raised floor in place of a floor tile at a floor tile receiving location and including an upper surface for flush disposition with the floor surface; an inlet chamber in said housing having a first inlet formed on the upper surface and opening into a space to be serviced and a second inlet opening located below the level of the raised floor to communicate with the plenum under said floor; an outlet chamber in said housing having an outlet formed in the upper surface and opening into the space to be serviced; an electric fan located between said inlet chamber and said outlet chamber to propel air from said inlet chamber to said outlet chamber; proportioning means for controlling the proportion of air flowing into the inlet chamber from said first inlet and said second inlet respectively; temperature sensing means for sensing the temperature of air entering said first inlet; and modulating means for modulating said proportioning means in accordance with the temperature of air entering said first inlet to control the temperature of the air propelled to the outlet chamber; and an electric power connection.

9. The terminal system of claim 8 further including a second air delivery means for delivering a cooling air stream to the conditioned space from the plenum, which delivery means is provided with a fan for propelling the air into the conditioned space and a moveable outlet means for directing the airstream.

10. The terminal system of claim 9 wherein the second delivery means includes a duct communicating with the plenum.

11. The terminal system of claim 10 wherein the duct further includes a first rigid portion extending vertically from the raised floor, a flexible portion extending from the first rigid portion and a second rigid portion extending substantially horizontally from the flexible portion.

* * * * *